US006151872A

United States Patent [19]

Rasmussen

[11] Patent Number: 6,151,872

[45] Date of Patent: Nov. 28, 2000

[54] HORSE REINS

[76] Inventor: Wayne J. Rasmussen, 325 Mountain Rd., Lebanon, N.J. 08833

[21] Appl. No.: 09/340,614

[22] Filed: Jun. 29, 1999

[51] Int. Cl.[7] ..... B68B 1/04

[52] U.S. Cl. ..... 54/36; 54/16; 54/73

[58] Field of Search ..... 54/36, 52, 16, 54/17, 73

[56] References Cited

U.S. PATENT DOCUMENTS

| | | | |
|---|---|---|---|
| 357,826 | 2/1887 | Heney | 54/73 |
| 751,953 | 2/1904 | Shuster | 54/52 |
| 791,845 | 6/1905 | Wavrunek | 54/52 |
| 815,216 | 3/1906 | Roberts | 54/52 |
| 899,281 | 9/1908 | Zeller | 54/13 |
| 908,309 | 12/1908 | McAulay | 54/33 |
| 1,117,606 | 11/1914 | Schrenkeisen | 24/16 R |
| 5,148,656 | 9/1992 | Meaghen | 54/36 |

*Primary Examiner*—Michael J. Carone
*Assistant Examiner*—James S. Bergin
*Attorney, Agent, or Firm*—Kenneth P. Glynn, Esq.

[57] ABSTRACT

The present invention is an improved horse rein with a main leather rein member and a hook stud assembly. The main leather rein member has a hook stud area located between the bit end and the hand end. The hook stud assembly is a heterogeneous structure with: (i.) the hook stud area of the main rein member being a leather base; (ii.) a hook stud having a stem and a hook stud base, with the hook stud base being located on the leather base; (iii.) a synthetic fabric reinforcement layer atop the base and atop the hook stud base. The synthetic fabric reinforcement layer has an orifice thereon through which the hook stud stem passes. It is preferably formed of nylon; and (iv.) a leather backing atop the synthetic fabric reinforcement layer and having an orifice thereon through which the hook stud stem passes. The assembly is permanently attached to one another, e.g. by stitching. In other embodiments, plural hook studs are used, with and without a synthetic fabric interlayer.

13 Claims, 2 Drawing Sheets

HORSE REINS

BACKGROUND OF THE INVENTION

1. Field of the Invention

The present invention relates to improved horse reins, and, more particularly, to horse reins having superior strength over other reins. Thus, the present invention reins have either a reinforcing interlayer at the hook stud area, or multiple hook studs, or both.

2. Information Disclosure Statement

"Horse reins" as used herein is taken to mean the reins used by persons to control the ride of a horse or other domesticated four-legged animal, e.g. mule, camel, etc., and is the set of straps which are typically hand held at one end and attached to a bit or similar device at the opposite end, and function to move, slow, stop or turn such an animal. Such reins have been used for centuries and have been crafted of leather or in more crude fashion, made of rope.

To illustrate the general construction and function of horse reins, U.S. Pat. No. 5,148,656 issued to Robert C. Meaghon describes training reins which simply add coded indicia to the structure of reins for training purposes.

Notwithstanding the prior art, the present invention is neither taught nor rendered obvious thereby.

SUMMARY OF THE INVENTION

The present invention is an improved horse rein with a main leather rein member and a hook stud assembly. The rein member has a bit end and a hand end, with the bit end being a point end with at least one hook stud slot contained therein, and the hand end having one of a buckle end and a buckle point end. The main rein member has a hook stud area located between the bit end and the hand end. The hook stud assembly is a heterogeneous structure with: (i.) the hook stud area of the main rein member being a leather base; (ii.) a hook stud having a stem and a hook stud base, with the hook stud base being located on the leather base; (iii.) a synthetic fabric reinforcement layer atop the base and atop the hook stud base. The synthetic fabric reinforcement layer has an orifice thereon through which the hook stud stem passes. It is preferably formed of nylon; and (iv.) a leather backing atop said synthetic fabric reinforcement layer and having an orifice thereon through which said hook stud stem passes. The assembly is permanently attached to one another, e.g. by stitching. In other embodiments, plural hook studs are used, with and without a synthetic fabric interlayer.

Thus, it is an object of the present invention to provide an improved horse rein which has the apprearance of a traditional other horse reins but contains features which both secure hook studs and decrease rupturing risk of contiguous leather components.

It is another object of the present invention to provide multiple hook studs both so as to create an attractive rein with extra strength and a safety back-up hook stud in the event that one horse rein might otherwise fail.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1B:
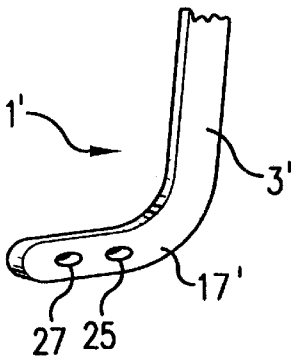
FIG. 1b PRIOR ART
FIGS. 1*a*, 1*b* and 2 show various views and embodiments of prior art horse reins.
Figure 1A:
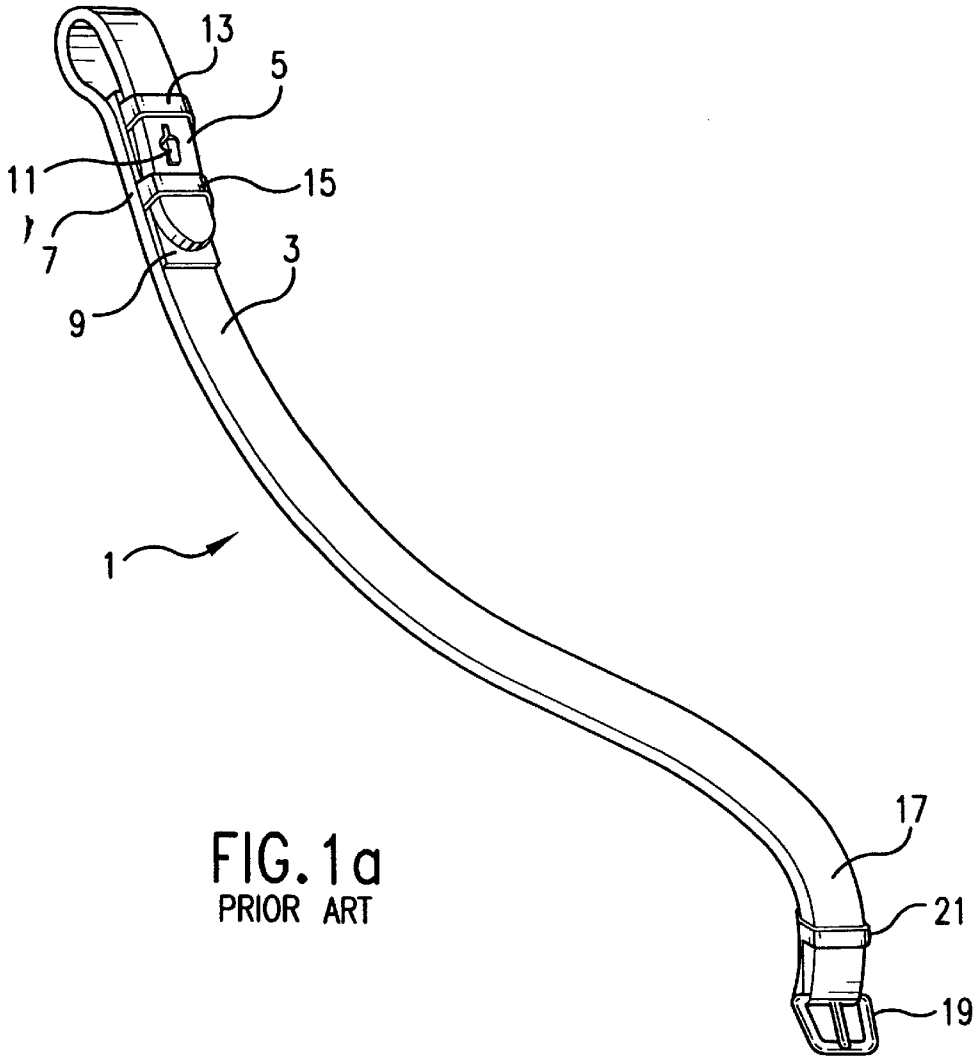
FIG. 1a PRIOR ART

FIGS. 1*a* and 1*b* show oblique views of a set of prior art reins, FIG. 1*a* showing a full view of a buckle end and FIG. 1*b* showing a partial cut view of a hand point end. Thus, FIG. 1*a* shows prior art reins 1 having a main leather member 3, with a bit end being point end 5 for attachment to a bit or similar device, and a hand end 17 having a buckle 19 and loop 21. Between the point end 5 and the hand end 17 is an area close to the point end 5 which is a hook stud area which includes hook stud 11 and leather backing 9. Point end 5 includes loops 13 and 15, as shown.

FIG. 1*b* shows a cut section of a rein 1' which is similar to rein 1 of FIG. 1*a*, except that hand end 17' of main leather member 3' has a hand point end with hook orifices 27 and 25. Traditionally, the handle end 17 of FIG. 1*a* and the hand end 17' of FIG. 1*b* are buckled together like a belt to form a set of reins, the point ends 5 being attached to a bit.

Figure 2:
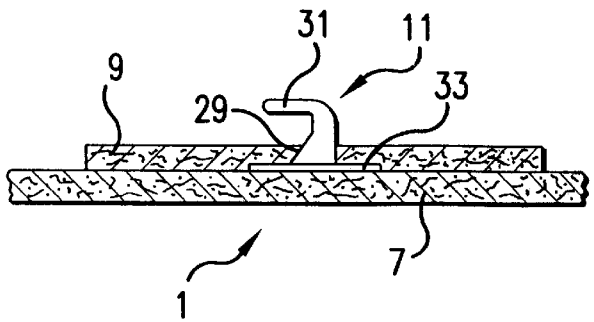
FIG. 2 PRIOR ART

FIG. 2 shows a side, partially cut view of prior art rein 1 of FIG. 1*a*, as to hook stud area 7, only. Referring to both FIGS. 1*a* and 2, it can be seen that hook stud 11 has a stem 31 and a base 33. The hook stud base 33 is located under leather backing 9, and hook stud stem 31 passes through orifice 29 of leather backing 9, which is stitched together (not shown) with hook stud area 7 to secure hook stud 11 in conventional reins.

Figure 3:
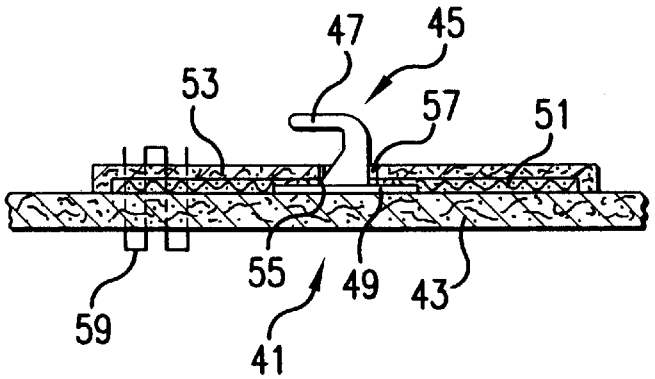
FIG. 3 shows a side, partially cut view of a present invention horse rein utilizing a single hook stud with a synthetic fabric reinforcement interlayer.

FIG. 3 shows one embodiment of a cut view of a present invention rein 41, at its hook stud area 43 of its main leather member. The ends of rein 43 are not shown because they are conventional, as already shown in FIGS. 1*a* and 1*b*. In FIG. 3, hook stud area 43 includes a synthetic fabric reinforcing layer 51 with orifice 55, located above hook stud base 49 with stem 47 of hook stud 45 extending through orifice 55. Atop synthetic fabric reinforcement layer 51 is leather backing strip 53 with stud orifice 57, through which hook stud stem 47 has been passed. The hook stud area 43, the synthetic fabric reinforcing layer 51 and the leather backing strip 53 are tightly assembled and permanently attached to one another to secure hook stud 45 using some known attachment mechanism, especially stitching, such as stitches 59, shown in partial view.

Figure 4:
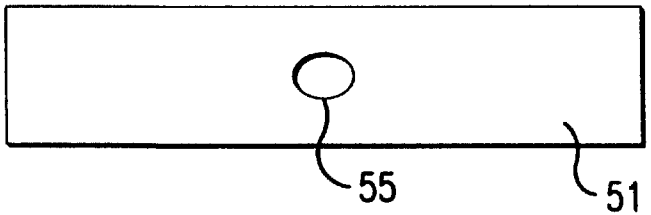
FIG. 4 illustrates a detailed top view of the synthetic fabric reinforcement interlayer used in the rein shown in FIG. 3.

The synthetic fabric reinforcement layer 51 is shown in more detail in FIG. 4, with orifice 55 formed as shown. The synthetic fabric reinforcement layers used in the present invention may be any known fabric (flexible sheet) in woven or unwoven form. Among those available are polypropylene blends, nylon, fiberglass, etc., with woven nylon being preferred. In one preferred embodiment, the synthetic fabric orifice is itself reinforced, to prevent ripping or rupture. In the case of nylon fabric, formation of the orifice is desirably achieved by both cutting and reinforcing by use of heat, i.e. burning the orifice into the fabric while heat sealing the burnt strands.

Figure 5:
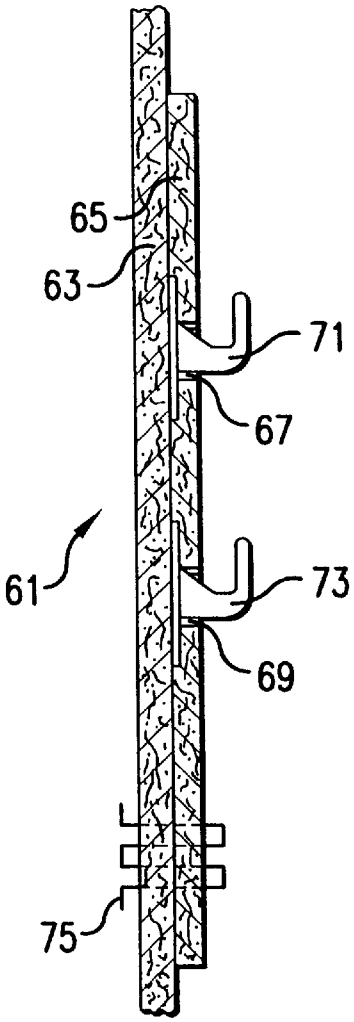
FIG. 5 illustrates a side, partially cut view of an alternative present invention rein utilizing plural hood studs; and, FIG. 6 illustrates a side, partially cut view of another alternative embodiment present invention rein which includes plural hook studs and a synthetic fabric reinforcement interlayer.

FIG. 5 shows a different alternative embodiment present invention rein 61. Here plural hook studs 71 and 73 are utilized. Rein 61 has its main leather rein member hook stud area 63, with the bases of hook leather backing strip 65 atop both studs and the main leather rein member hook stud area 63 to sandwich both hook studs 71 and 73 therebetween, extending through backing strip orifices 67 and 69, respectively, as shown. This assembly is permanently connected securely together with stitching 75, shown partially, but containing the full length of leather backing strip 65 on both sides and at the ends thereof.

Figure 6:
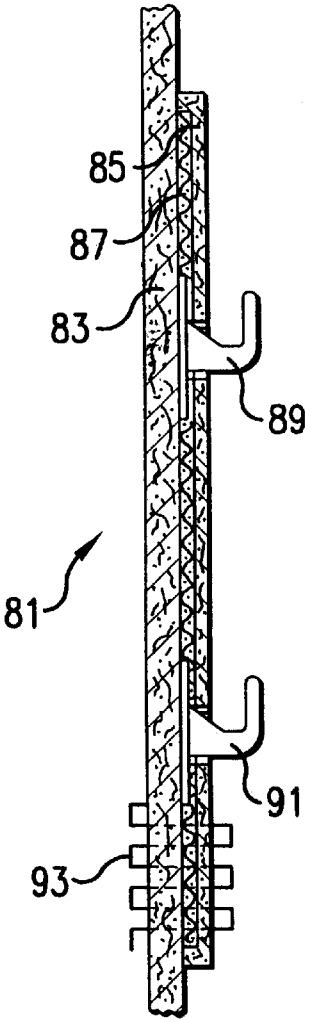

FIG. 6 shows yet another present invention embodiment, wherein both multiple hood studs and synthetic fabric reinforcement layers are utilized. Here, rein 81 has its main leather rein member 83 with top leather backing strip 85 and synthetic fabric interlayer 87 therebetween. Multiple hook studs 89 and 91 have bases adjacent main leather rein member 83 with their stems extending through aligned orifices located in synthetic fabric interlayer 87 and atop leather backing strip 85, as shown. The assembly is secured tightly together with stitching as partially represented by stitches 93.

Obviously, numerous modifications and variations of the present invention are possible in light of the above teachings. It is therefore understood that within the scope of the appended claims, the invention may be practiced otherwise than as specifically described herein.

What is claimed is:

1. An improved horse rein, which comprises:

a.) a main leather rein member having a bit end and a hand end, said bit end being a point end with at least one hook stud slot contained therein, and said hand end having one of a buckle end and a buckle point end, said main rein member having a hook stud area located between said bit end and said hand end;

b.) a hook stud assembly comprising a heterogeneous structure with:

(i.) the hook stud area of said main rein member being a leather base;

(ii.) a hook stud having a stem and a hook stud base, said hook stud base being located on said leather base;

(iii.) a synthetic fabric reinforcement layer atop said leather base and atop said hook stud base, said synthetic fabric reinforcement layer having an orifice thereon through which said hook stud stem passes;

(iv.) a leather backing strip atop said synthetic fabric reinforcement layer and having an orifice thereon through which said hook stud stem passes;

c.) means for permanently attaching said leather base, said synthetic fabric reinforcement layer and said leather backing strip to one another.

2. The improved horse rein of claim 1 wherein said synthetic fabric reinforcement layer is a woven synthetic fabric.

3. The improved horse rein of claim 2 wherein said synthetic fabric reinforcement layer is nylon.

4. The improved horse rein of claim 3 wherein said orifice located on said synthetic fabric reinforcement layer is a heat-sealed orifice with melded edging.

5. The improved horse rein of claim 3 wherein said leather base, said synthetic fabric reinforcement layer and said leather backing strip are permanently connected to one another with stitching.

6. The improved horse rein of claim 1 wherein said leather base, said synthetic fabric reinforcement layer and said leather backing strip are permanently connected to one another with stitching.

7. The improved horse rein of claim 1 wherein said leather base and said leather backing strip are permanently connected to one another with stitching.

8. An improved horse rein, which comprises:

a.) a main leather rein member having a bit end and a hand end, said bit end being a point end with at least two hook stud slots contained therein, and said hand end having one of a buckle end and a buckle point end, said main rein member having a hook stud area located between said bit end and said hand end;

b.) a hook stud assembly comprising a heterogeneous structure with:

(i.) the hook stud area of said main rein member being a leather base;

(ii.) at least two hook studs, each hook stud having a stem and a hook stud base, said hook stud base of each of said at least two hook studs being located on said leather base;

(iii.) a synthetic fabric reinforcement layer atop said leather base and atop said hook stud bases, said synthetic fabric reinforcement layer having an orifice thereon for each of said at least two hook studs through which said hook stud stem passes;

(iv.) a leather backing strip atop said synthetic fabric reinforcement layer and having an orifice thereon for each of said at least two hook studs through which said hook stud stem passes;

c.) means for permanently attaching said leather base, said synthetic fabric reinforcement layer and said leather backing strip to one another.

9. The improved horse rein of claim 8 wherein said synthetic fabric reinforcement layer is a woven synthetic fabric.

10. The improved horse rein of claim 9 wherein said synthetic fabric reinforcement layer is nylon.

11. The improved horse rein of claim 10 wherein said orifice located on said synthetic fabric reinforcement layer is a heat-sealed orifice with melded edging.

12. The improved horse rein of claim 10 wherein said leather base, said synthetic fabric reinforcement layer and said leather backing strip are permanently connected to one another with stitching.

13. The improved horse rein of claim 8 wherein said leather base, said synthetic fabric reinforcement layer and said leather backing strip are permanently connected to one another with stitching.

* * * * *